US011221573B2

(12) United States Patent
Nakamura

(10) Patent No.: US 11,221,573 B2
(45) Date of Patent: Jan. 11, 2022

(54) BELT DEVICE AND IMAGE FORMING APPARATUS INCLUDING THE BELT DEVICE WITH WHICH CREASES DUE TO AN UNDULATION OF A BELT MAY BE SUPPRESSED

(71) Applicant: SHARP KABUSHIKI KAISHA, Sakai (JP)

(72) Inventor: Ginga Nakamura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/229,082

(22) Filed: Apr. 13, 2021

(65) Prior Publication Data

US 2021/0333729 A1 Oct. 28, 2021

(30) Foreign Application Priority Data

Apr. 28, 2020 (JP) ..... JP2020-079639

(51) Int. Cl.
*G03G 15/16* (2006.01)

(52) U.S. Cl.
CPC ..... *G03G 15/1615* (2013.01)

(58) Field of Classification Search
CPC ..... G03G 15/1605; G03G 15/1615
USPC ..... 399/302, 308
See application file for complete search history.

(56) References Cited

U.S. PATENT DOCUMENTS 7,905,346 B2 * 3/2011 Enomoto ..... G03G 15/1615 198/807
10,322,893 B2 * 6/2019 Nakajima ..... G03G 15/1615
2021/0240110 A1 * 8/2021 Miyake ..... G03G 15/1615

FOREIGN PATENT DOCUMENTS

JP 2015206864 A 11/2015

* cited by examiner

*Primary Examiner* — William J Royer
(74) *Attorney, Agent, or Firm* — ScienBiziP, P.C.

(57) ABSTRACT

A belt device includes a first stretching member and a detector. The first stretching member stretches an endless belt capable of rotational movement. The detector detects a base of the belt and/or a density of a toner image on the belt. The first stretching member includes a first parallel area that is parallel to an axial direction, which is a direction of a rotation axis of the belt, and a first inclined area that is connected to an outer side of the first parallel area with respect to the axial direction and is inclined in a direction closer to the rotation axis. The detector detects a location corresponding to a first boundary between the first parallel area and the first inclined area or a location corresponding to a predetermined first adjacent area that is adjacent to and on an inner side of the first boundary.

11 Claims, 16 Drawing Sheets

BELT DEVICE AND IMAGE FORMING APPARATUS INCLUDING THE BELT DEVICE WITH WHICH CREASES DUE TO AN UNDULATION OF A BELT MAY BE SUPPRESSED

CROSS-REFERENCE TO RELATED APPLICATION

The present application claims priority from Japanese Application Number JP2020-79639, the content to which is hereby incorporated by reference into this application.

BACKGROUND OF THE INVENTION

Field of the Invention

One aspect of the present invention relates to a belt device and an image forming apparatus, such as a copier, a multi-function peripheral, a facsimile machine, or a printer, including the belt device.

Description of the Related Art

There is a conventionally known belt device (e.g., transfer belt device) in which a stretching member stretches an endless belt capable of rotational movement (e.g., transfer belt) and a detector detects the density of a toner image on the belt.

In an image forming apparatus including the belt device, to adjust the density of a toner image, the base of the belt is detected by the detector, and zero point adjustment (calibration) is performed based on a detection result of the detected base. Subsequently, a toner image is formed on the belt, the formed toner image is detected by the detector, and the density of the toner image is adjusted based on a detection result of the detected toner image.

In this kind of image forming apparatus, when the detector detects the base of the belt and/or a toner image, it may be difficult to detect the base of the belt and/or the toner image with high accuracy due to a crease caused by the undulation on the surface of the belt itself.

In this respect, Japanese Unexamined Patent Application Publication No. 2015-206864 discloses a belt device including a stretching roller that is formed to have a convex crown shape with a decreasing diameter from the middle part of the peripheral surface with respect to the rotation axis direction toward both ends thereof.

SUMMARY OF THE INVENTION

With the belt device disclosed in Japanese Patent Application Laid-Open No. 2015-206864, although creases due to the undulation of the belt may be suppressed in the vicinity of the stretching roller, there is still difficulty in accurately detecting the base of the belt and/or the toner image with the detector in a certain installation position.

Therefore, one aspect of the present invention has an object to provide a belt device and an image forming apparatus including the belt device with which creases due to the undulation of the belt may be suppressed and the base of the belt and/or toner image may be detected with high accuracy.

In order to solve the above-described issue, the inventor has obtained the findings described below. Specifically, it has been found out that, in a belt device where a stretching member stretches an endless belt capable of rotational movement and a detector detects a density of a toner image on the belt, a first stretching member is used, which includes a first parallel area that is parallel to an axial direction, which is a direction of a rotation axis of the belt, and a first inclined area that is connected to an outer side of the first parallel area with respect to the axial direction and is inclined in a direction closer to the rotation axis, and a location corresponding to a first boundary between the first parallel area and the first inclined area is detected by the detector, whereby the base of the belt and/or the toner image may be detected with high accuracy. Here, it is preferable that the detector detects the location corresponding to the first boundary; however, there may be a reduction in the detection accuracy if the detector detects the location corresponding to an outer side (inclined area) of the first boundary due to a detection error of the detector, a dimensional variation of the first stretching member, and an assembly variation of the detector. Therefore, in consideration of a detection error of the detector, a dimensional variation of the first stretching member, and an assembly variation of the detector, it is preferable to detect the predetermined first adjacent area that is adjacent to and on the inner side of the first boundary.

One aspect of the present invention has been completed based on such findings. A belt device according to one aspect of the present invention includes a first, stretching member that stretches an endless belt capable of rotational movement, and a detector that detects a base of the belt and/or a density of a toner image on the belt, wherein the first stretching member includes a first parallel area that is parallel to an axial direction, which is a direction of a rotation axis of the belt, and a first inclined area that is connected to an outer side of the first parallel area with respect to the axial direction and is inclined in a direction closer to the rotation axis, and the detector detects a location corresponding to a first boundary between the first parallel area and the first inclined area or a location corresponding to a predetermined first adjacent area that is adjacent to and on an inner side of the first boundary. Furthermore, an image forming apparatus according to one aspect of the present invention includes the belt device according to the aspect of the present invention.

According to one aspect of the present invention, creases due to the undulation of the belt, may be avoided, and the base of the belt and/or a toner image may be detected with high accuracy.

DETAILED DESCRIPTION OF THE INVENTION

Figure 1:
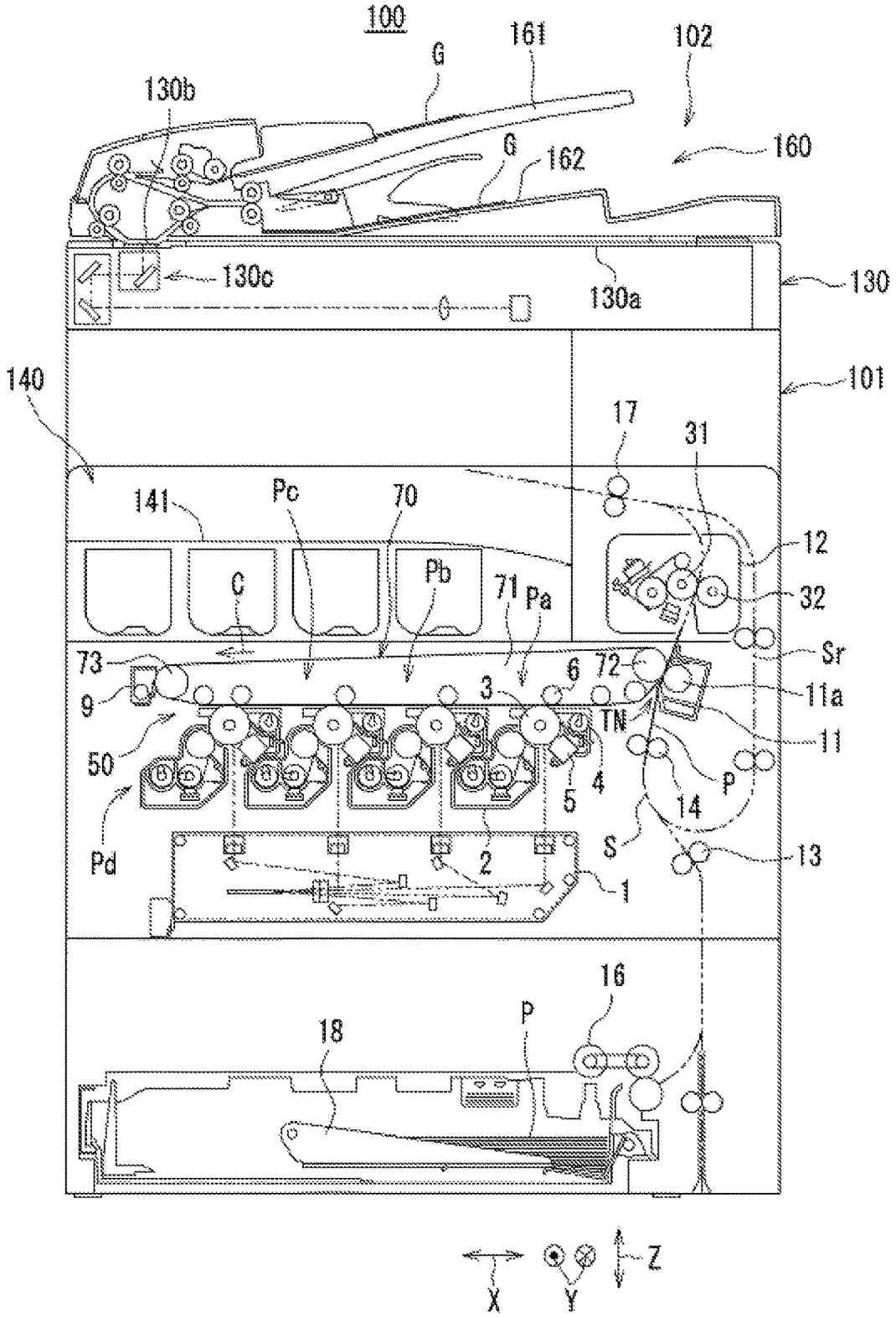
FIG. 1 is a front transparent view illustrating a schematic configuration of an image forming apparatus according to the present embodiment.

Embodiments of the present invention are described below with reference to the drawings. In the following description, the same components are denoted by the same reference numeral. Their names and functions are also identical. Therefore, the detailed description thereof is not repeated.

Description of Overall Image Forming Apparatus

FIG. 1 is a front transparent view illustrating a schematic configuration of an image forming apparatus 100 according to the present embodiment. In FIGS. 1, 2 to 5, and 10 to 13 described below, the reference letter X denotes a right-and-left direction, the reference letter Y denotes a front-and-back direction, and the reference letter Z denotes an up-and-down direction.

The image forming apparatus 100 is a multifunction peripheral having a copy function, a scanner function, a facsimile function, and a printer function to transmit an image of a document G read by an image reading device 102 to outside. The image forming apparatus 100 forms the image of the document G read by the image reading device 102 or an image received from outside on a sheet P, such as paper, in color or monochrome.

A document feeder 160 (automatic document feeder (ADF)) is provided above an image reader 130 and supported by the image reader 130 so as to be opened and closed. The image reading device 102 includes the document feeder 160. The document feeder 160 sequentially feeds the one or more documents G one by one. The image reading device 102 reads the individually conveyed document G out of the one or more documents G fed by the document feeder 160. The image reading device 102 includes a platen 130*a* (document placement table) where the document G is placed, and a placed document reading function to read the document placed on the platen 130*a*. In the image forming apparatus 100, when the document feeder 160 is opened, the platen 130*a* above the image reader 130 is opened so that the document G may be placed by hand. The document feeder 160 includes a document placement tray 161 (placement tray) where the document G is placed, and a document ejection tray 162 (ejection tray) where the document G is ejected to outside and stocked. The image reading device 102 has a fed document reading function to read the document G fed by the document feeder 160. The document feeder 160 feeds the document G placed on the document placement tray 161 onto a document reader 130*b* in the image reader 130. The image reader 130 causes an optical scanning system 130*c* to scan so as to read a document placed on the platen 130*a* or reads the document G fed by the document feeder 160 so as to generate image data.

An image forming apparatus main body 101 includes an optical scanning device 1, a developing device 2, a photosensitive drum 3 (an example of an image carrier), a drum cleaning device 4, a charger 5, a transfer belt device 70 (intermediate transfer belt device) (an example of a belt device), a secondary transfer device 11, a fixing device 12, a sheet conveyance path S, a sheet feed cassette 18, and a sheet ejection tray 141 (internal ejection tray).

The image forming apparatus 100 processes the image data corresponding to a color image using colors of black (K), cyan (C), magenta (M), and yellow (Y), or a monochrome image using monochrome (e.g., black). To form four types of toner images, an image transferrer 50 of the image forming apparatus 100 includes four developing devices 2, four photosensitive drums 3, four drum cleaning devices 4, and four chargers 5, which correspond to black, cyan, magenta, and yellow, respectively, and constitute four image stations Pa, Pb, Pc, and Pd.

The optical scanning device 1 exposes the surface of the photosensitive drum 3 to form an electrostatic latent image. The developing device 2 develops the electrostatic latent image on the surface of the photosensitive drum 3 to form a toner image on the surface of the photosensitive drum 3. The drum cleaning device 4 removes and collects residual toner on the surface of the photosensitive drum 3. The charger 5 uniformly charges the surface of the photosensitive drum 3 so as to have a predetermined potential. During the series of operations described above, toner images in respective colors are formed on the surfaces of the respective photosensitive drums 3.

The transfer belt device 70 includes a transfer roller 6 (intermediate transfer roller), an endless transfer belt 71 (intermediate transfer belt) (an example of a belt), a transfer drive roller 72, a transfer follower roller 73, and a cleaning device 9 (belt cleaning device). Four transfer rollers 6 are provided inside the transfer belt 71 so as to form four types of toner images corresponding to the respective colors. The transfer roller 6 transfers the toner image in each color formed on the surface of the photosensitive drum 3 onto the transfer belt 71 that rotates in a circumferential direction C.

The transfer belt 71 stretches between the transfer drive roller 72 and the transfer follower roller 73. In the image forming apparatus 100, the residual toner is removed and collected by the cleaning device 9, and the toner images in the respective colors formed on the surfaces of the photosensitive drums 3 are sequentially transferred and superimposed so that the color toner image is formed on the surface of the transfer belt 71. The cleaning device 9 removes and collects the waste toner that has not been transferred onto the sheet P and remains on the surface of the transfer belt 71.

The secondary transfer device 11 forms a transfer nip area TN (nip area) between a secondary transfer roller 11*a* (an example of an opposing roller) and the transfer belt 71 to nip and convey the sheet P, which is conveyed through the sheet conveyance path S, in the transfer nip area TN. When the sheet P is passed through the transfer nip area TN, the toner image on the surface of the transfer belt 71 is transferred onto the sheet P, and the sheet P is conveyed to the fixing device 12.

The fixing device 12 includes a fixing roller 31 and a pressure roller 32 that rotate with the sheet P sandwiched therebetween. The fixing device 12 applies heat and pressure to the sheet P while the sheet P having the toner image transferred thereon is sandwiched between the fixing roller 31 and the pressure roller 32 so as to fix the toner image to the sheet P.

The sheet feed cassette 18 is a cassette that is provided under the optical scanning device 1 to store the sheet P used for image formation. The sheet P is pulled out from the sheet feed cassette 18 by a pickup roller 16 and conveyed to the sheet conveyance path S. After being conveyed to the sheet conveyance path S, the sheet P is passed through the secondary transfer device 11 and the fixing device 12, conveyed to an ejection roller 17, and ejected to the sheet ejection tray 141 in an ejector 140. A conveyance roller 13, a registration roller 14, and the ejection roller 17 are provided in the sheet conveyance path S. The conveyance roller 13 promotes the conveyance of the sheet P. The registration roller 14 temporarily stops the sheet P to align the leading edge of the sheet P. The registration roller 14 conveys the temporarily stopped sheet P in synchronized timing with the color toner image on the transfer belt 71. The color toner image on the transfer belt 71 is transferred onto the sheet P in the transfer nip area TN between the transfer belt 71 and the secondary transfer roller 11*a*.

Although the single sheet feed cassette 18 is provided in FIG. 1, this is not a limitation, and a configuration may be such that sheet feed cassettes 18 are provided to store different types of sheets P.

When the image forming apparatus 100 forms an image on not only the front surface but also the back surface of the sheet P the sheet P is conveyed in the opposite direction from the ejection roller 17 to a sheet reverse path Sr. The image forming apparatus 100 turns over the sheet P conveyed in the opposite direction and guides the sheet P to the registration roller 14 again. The image forming apparatus 100 forms an image on the back surface of the sheet P guided to the registration roller 14 in the same manner as for the front surface and delivers the sheet P to the sheet ejection tray 141.

Transfer Belt Device

Figure 2:
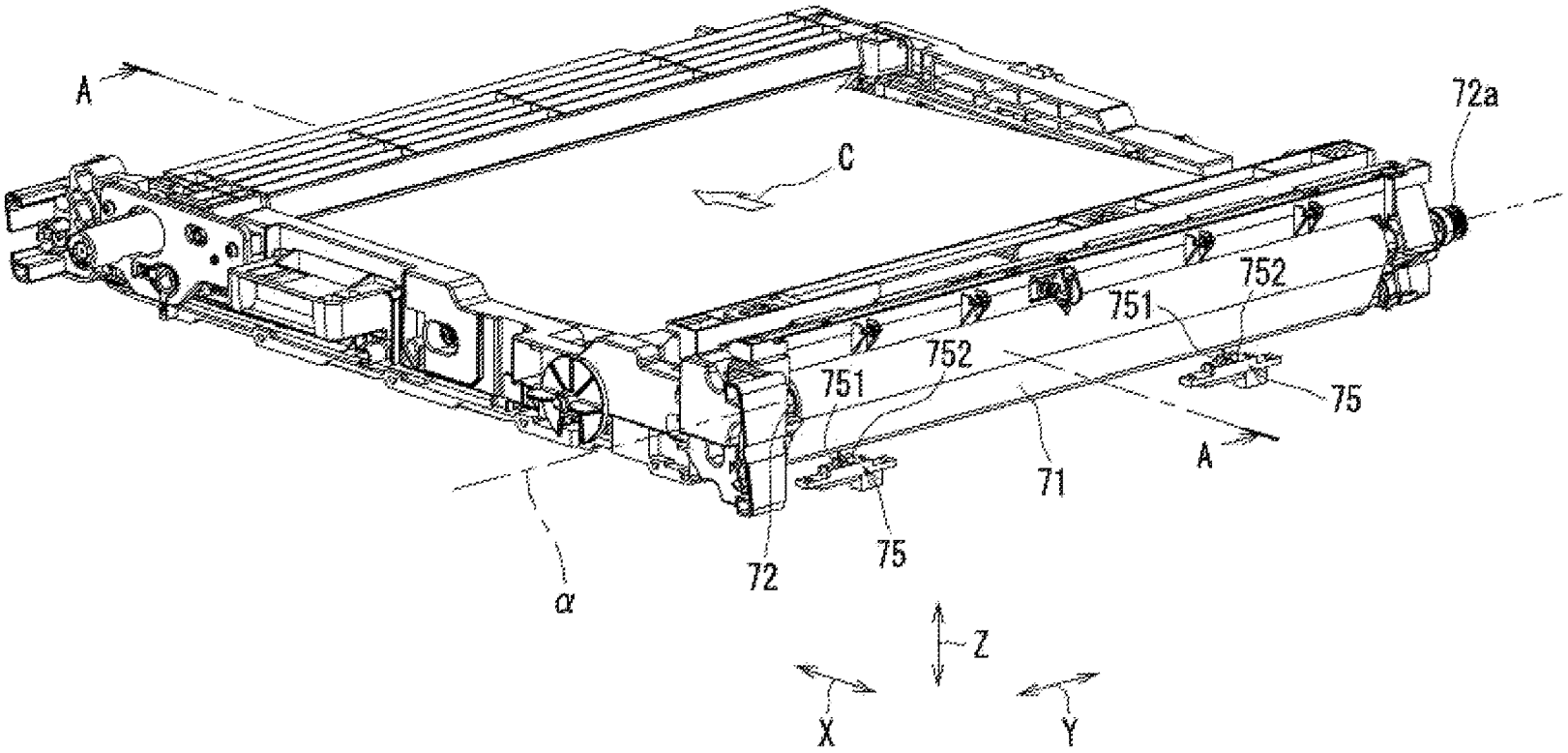
FIG. 2 is a perspective view of a transfer belt device in the image forming apparatus illustrated in FIG. 1 as viewed diagonally from the upper right.
Figure 3:
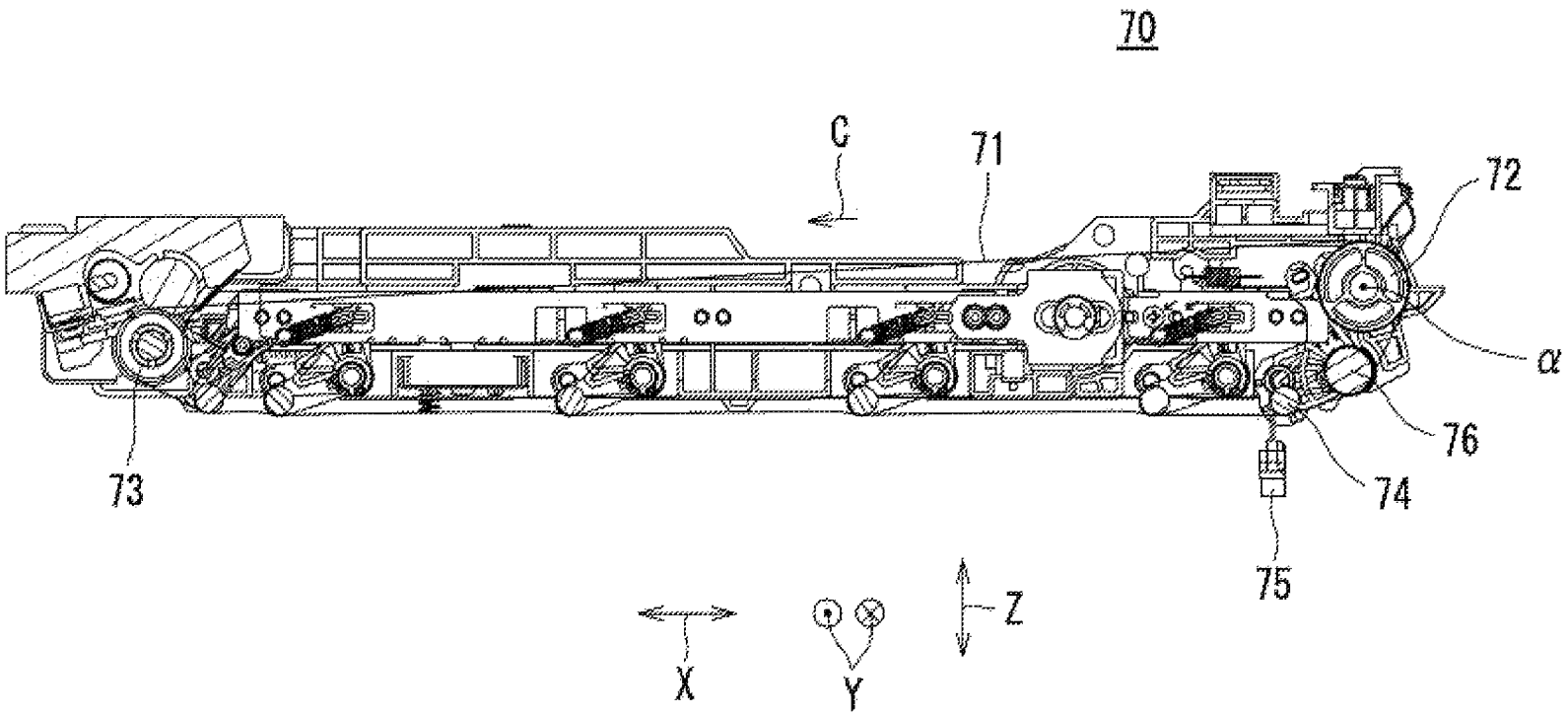
FIG. 3 is a cross-sectional view of the transfer belt device along the line A-A illustrated in FIG. 2.
Figure 4:
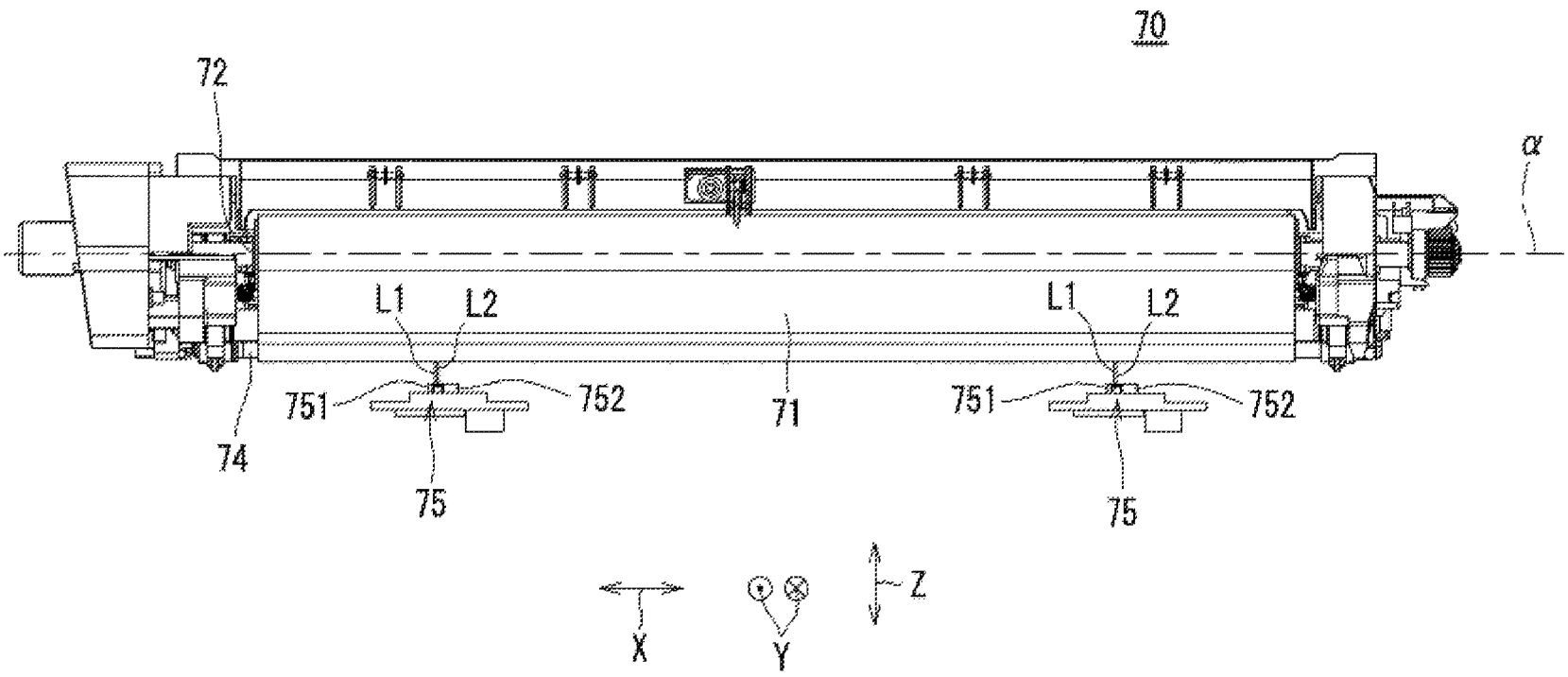
FIG. 4 is a side view of the transfer belt device as viewed from the right side.
Figure 5:
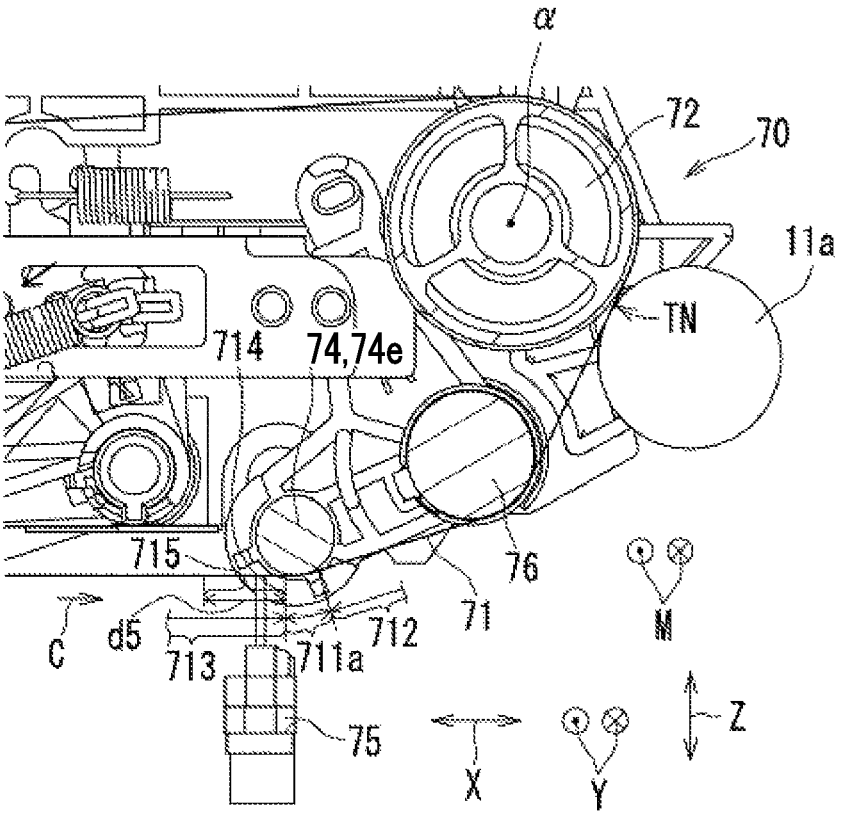
FIG. 5 is a cross-sectional view illustrating areas of a first stretching member and detectors illustrated in FIG. 3 together with a secondary transfer roller.

FIG. 2 is a perspective view of the transfer belt device 70 in the image forming apparatus 100 illustrated in FIG. 1 as viewed diagonally from the upper right. FIG. 3 is a cross-sectional view of the transfer belt device 70 along the line A-A illustrated in FIG. 2. FIG. 4 is a side view of the transfer belt device 70 as viewed from the right side. FIG. 5 is a cross-sectional view illustrating the areas of a first stretching member 74 and detectors 75 illustrated in FIG. 3 together with the secondary transfer roller 11*a*.

The transfer belt device 70 includes the transfer belt 71, the transfer drive roller 72, the transfer follower roller 73, the first stretching member 74, and the detectors 75. The transfer belt 71 is an endless belt capable of rotational movement. The transfer drive roller 72, the transfer follower roller 73, and the first stretching member 74 are wound around the transfer belt 71 so that the transfer belt 71 stretches therebetween. A rotational drive force is transmitted from a rotary drive (drive motor) (not illustrated) to the transfer drive roller 72 via a drive gear 72*a* (see FIG. 2). This allows the transfer belt 71 to rotate around a rotation axis α in the circumferential direction C. The detectors 75 detect (read) the base of the transfer belt 71. The detectors 75 also detect the density of a toner image (e.g., an adjustment pattern image, what is called a patch image) formed by the image transferrer 50 and transferred onto the transfer belt 71 by the transfer roller 6. The detectors 75 include a light emitter 751 including a light emitting element (specifically, a light emitting diode) and a light receiver 752 including a light receiving element (specifically, a photodiode). The light emitter 751 irradiates the base of the transfer belt 71 and/or the toner image on the transfer belt 71 with emission light (see FIG. 4). The light receiver 752 receives reflected light L2 (see FIG. 4) that is reflected by the base of the transfer belt 71 and/or the toner image on the transfer belt 71. In the image forming apparatus 100, to adjust the density of a toner image, the base of the transfer belt 71 is detected by the detectors 75, and zero point adjustment (calibration) is performed based on a detection result of the detected base. Subsequently, a toner image is formed on the transfer belt 71, the formed toner image is detected by the detectors 75, and the density of the toner image is adjusted based on a detection result of the detected toner image.

With a conventional image forming apparatus, when the base of the transfer belt and/or a toner image is detected by a detector, it may be difficult to detect the base of the belt and/or the toner image with high accuracy due to a crease caused by the undulation on the surface of the belt itself.

With Regard to Present Embodiment

In this respect, the present embodiment has the configuration illustrated in FIGS. 6 to 13. Specifically, the first stretching member 74 includes a first parallel area 741 and first inclined areas 742 (see FIGS. 6 to 9B and 11A to 13). The first parallel area 741 is an area whose surface is parallel to an axial direction M that is the direction of the rotation axis α. The first inclined areas 742 are connected to the outer sides of the first parallel area 741 with respect to the axial direction M and are inclined in a direction closer to the rotation axis α. Specifically, the first inclined areas 742 are areas that are connected to at least one of the outer sides (the two outer sides in this example) of the first parallel area 741 with respect to the axial direction M and have a gradually increasing distance from a first virtual line β1 touching the first parallel area 741 toward the ends in the axial direction M. This allows the transfer belt 71 to stretch from the first parallel area 741 to the first inclined areas 742, whereby it is possible to suppress creases due to the undulation of the transfer belt 71.

The detectors 75 detect the locations corresponding to predetermined first adjacent areas 744 that are adjacent to and on the inner side of first boundaries 743 between the first parallel area 741 and the first inclined areas 742. The detectors 75 may detect the locations corresponding to the first boundaries 743. Thus, the base of the transfer belt 71 and/or the toner image may be detected with high accuracy.

When an inclination angle θ1 with respect to the first inclined areas 742 is 45 degrees or more, the stretch of the transfer belt 71 from the first parallel area 741 to the first inclined areas 742 is likely to reduce, and the corners of the first boundaries 743 are likely to damage the transfer belt 71 (for example, a folding line or a crack of the transfer belt 71).

In this respect, according to the present embodiment, the inclination angle θ1 of the first stretching member 74 with respect to the first inclined areas 742 is 45 degrees or less.

Thus, it is possible to suppress a reduction in the stretch of the transfer belt 71 from the first parallel area 741 to the first inclined areas 742 and to suppress damages to the transfer belt 71 by the corners of the first boundaries 743.

First Embodiment

Figure 6:
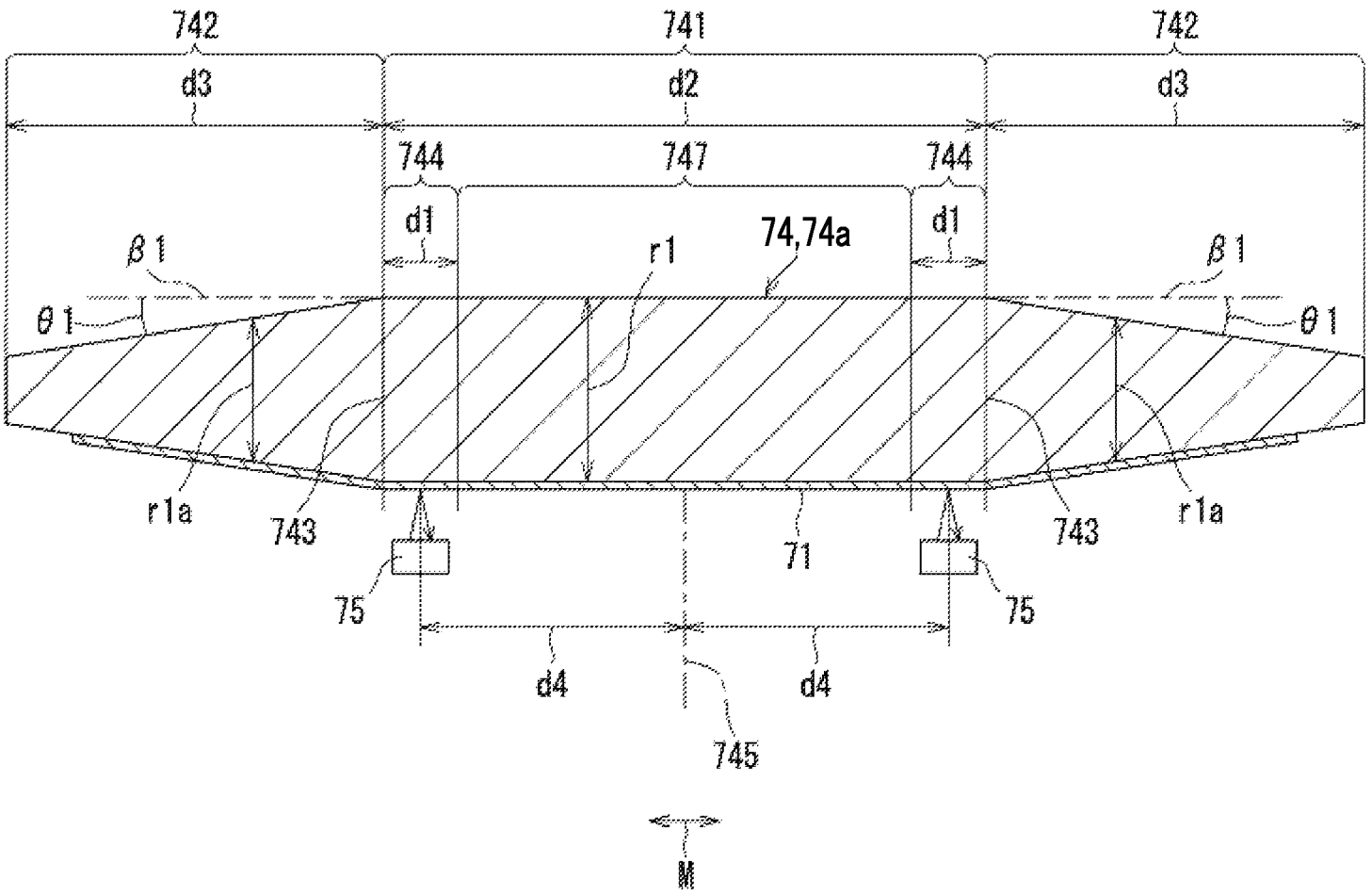
FIG. 6 is a cross-sectional view schematically illustrating an example in which a first stretching roller is used as the first stretching member according to a first embodiment.

FIG. 6 is a cross-sectional view schematically illustrating an example in which a first stretching roller 74*a* is used as the first stretching member 74 according to the first embodiment.

According to the present embodiment, as illustrated in FIG. 6, the first stretching member 74 is the first stretching roller 74*a*. The first inclined areas 742 are areas that are connected to the outer sides of the first parallel area 741 with respect to the axial direction M and have a gradually decreasing diameter r1*a* of the first stretching roller 74*a* toward the ends in the axial direction M. Thus, it is possible to ensure that the first stretching roller 74*a* stretches the transfer belt 71 from the first parallel area 741 to the first inclined areas 742, whereby creases due to the undulation of the transfer belt 71 may be certainly suppressed.

A first distance d1 of the first adjacent areas 744 in the axial direction M may be about half the circumference of the first parallel area 741 (when a first diameter of the first parallel area 741 is r1, r1×π/2, i.e., 12.6 mm when r1=8 mm) or less than about 1/20 of a second distance d2 of the first parallel area 741 in the axial direction M (d2/20, i.e., 11.5 mm when d2=230 mm). In this example, the first distance d1 of the first adjacent areas 744 is 10 mm. A third distance d3 of the first inclined areas 742 in the axial direction M is 43 mm, and the inclination angle θ1 of the first inclined areas 742 is 0.4 degrees. The detectors 75 are disposed such that the detection positions are located away from a center line 745 (the center of the first parallel area 741) by a predetermined fourth distance d4. The fourth distance d4 may be in the range between about one-third of the maximum size of the sheet P in the axial direction M and about one-third of the width of the transfer belt 71 in the axial direction M. According to the present embodiment, the maximum size of the sheet P in the axial direction M is A3 vertical size and A4 horizontal size (297 mm). In this case, the width of the transfer belt 71 in the axial direction M may be for example 335 mm, and the fourth distance d4 may be for example 110 mm.

With regard to the arrangement of the detectors 75 in the circumferential direction C around the rotation axis α, as illustrated in FIG. 5, a crease due to the undulation of the transfer belt 71 is likely to occur on a contact area 711*a* where the first stretching roller 74*a* is in contact with the transfer belt 71 and on a non-contact area 712 on the downstream side of the contact area 711*a* in the circumferential direction C and, when the detectors 75 detect the location corresponding to the contact area 711*a* and the location corresponding to the non-contact area 712 on the downstream side, there is a reduction in the detection accuracy of the base of the transfer belt 71 and/or the toner image. On the other hand, a crease due to the undulation of the transfer belt 71 is unlikely to occur on a predetermined second adjacent area 715 that is located on the upstream side of and adjacent to a second boundary 714 between the contact area 711*a* and a non-contact area 713 on the upstream side of the contact area 711*a* in the circumferential direction C.

In this respect, according to the present embodiment, the detectors 75 detect the location corresponding to the second adjacent area 715. Thus, it is possible to effectively prevent a reduction in the detection accuracy of the base of the transfer belt 71 and/or the toner image, as a crease due to the undulation of the transfer belt 71 is unlikely to occur on the second adjacent area 715 and therefore the detectors 75 detect the location corresponding to the second adjacent area 715.

A fifth distance d5 of the second adjacent area 715 in the circumferential direction C may be less than about the radius of the first stretching roller 74*a* (half of the first diameter r1, 8 mm/2=4 mm in this example). In this example, the fifth distance d5 of the second adjacent area 715 is 3.5 mm.

As illustrated in FIG. 5, the transfer nip area TN (nip area) between the transfer belt 71 and the secondary transfer roller 11*a* (opposing roller) is present on the downstream side of the first stretching member 74 (the first stretching roller 74*a* in this example) in the circumferential direction C around the rotation axis α. From the viewpoint of an improvement in the image quality of a transferred image, there is a need to suppress a crease due to the entire undulation in the axial direction M on the upstream side of the transfer nip area TN of the transfer belt 71 in the circumferential direction C.

In this respect, according to the present embodiment, the transfer belt device 70 includes a second stretching roller 76. The second stretching roller 76 is located downstream of the first stretching member 74 (74*a*) in the circumferential direction C around the rotation axis α and is located upstream of the transfer nip area TN (nip area) between the transfer belt 71 and the secondary transfer roller 11*a* (opposing roller). That is, the second stretching roller 76 is disposed inside the transfer belt 71 and between the first stretching member 74 (74*a*) and the transfer nip area TN (nip area) in a rotation path of the transfer belt 71.

Figure 7:
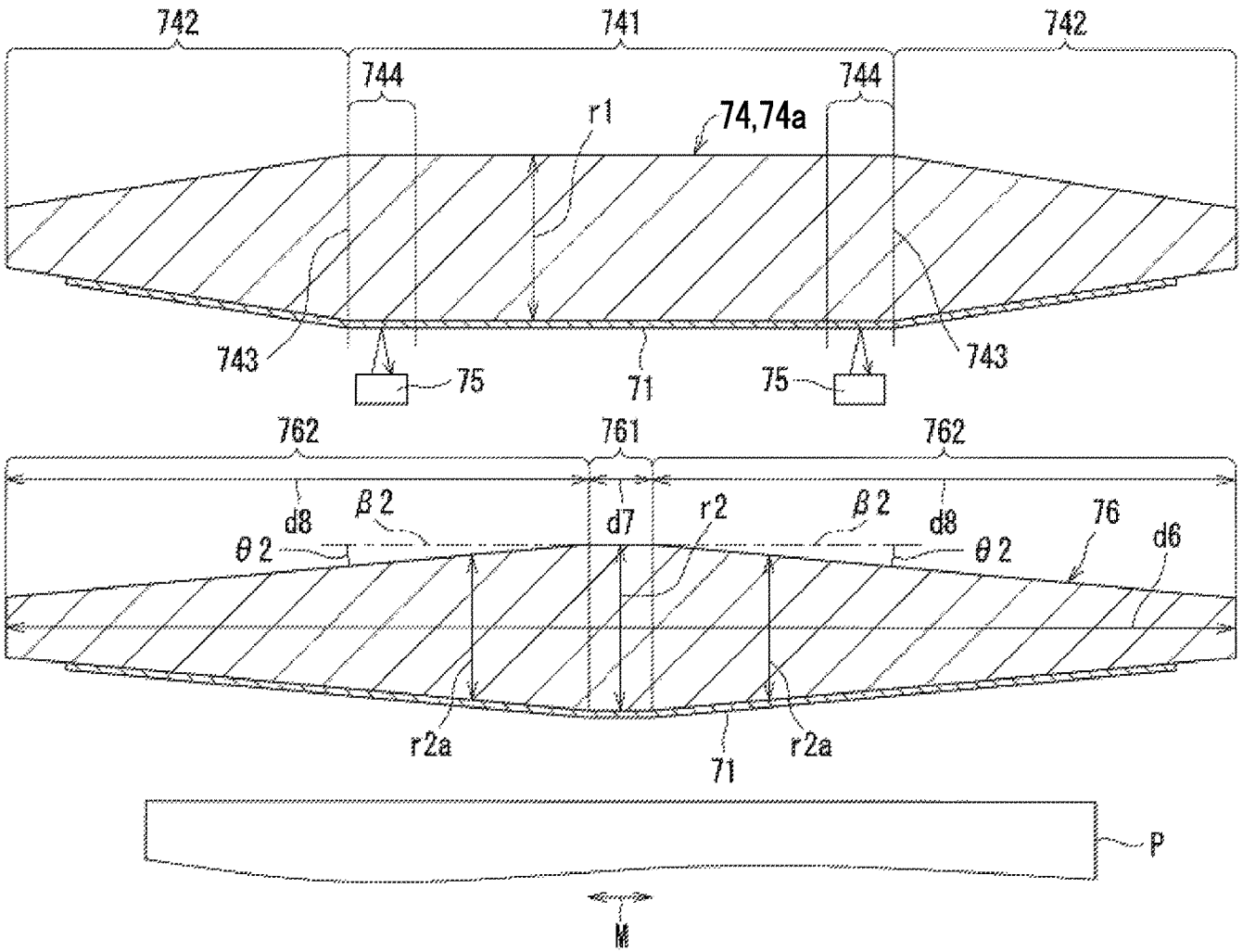
FIG. 7 is a cross-sectional view schematically illustrating the first stretching member and a second stretching roller together with a sheet according to the first embodiment.

FIG. 7 is a cross-sectional view schematically illustrating the first stretching member 74 (74*a*) and the second stretching roller 76 together with the sheet P according to the first embodiment.

As illustrated in FIG. 7, the second stretching roller 76 includes a second parallel area 761 and second inclined areas 762. The second parallel area 761 is an area whose surface is parallel to the axial direction M. The second inclined areas 762 are connected to the outer sides of the second parallel area 761 with respect to the axial direction M and are inclined in a direction closer to the rotation axis α. Specifically, the second inclined areas 762 are areas that are connected to the outer sides of the second parallel area 761 with respect to the axial direction M and have a gradually increasing distance from a second virtual line β2 touching the second parallel area 761 toward the ends in the axial direction M. The second inclined areas 762 are areas that are connected to the outer sides of the second parallel area 761 with respect to the axial direction M and have a gradually decreasing diameter r2*a* of the second stretching roller 76 toward the ends in the axial direction M. Therefore, it is possible to suppress a crease due to the entire undulation in the axial direction M on the upstream side of the transfer nip area TN (nip area) of the transfer belt 71 in the circumferential direction C, and thus it is possible to improve the image quality of a toner image.

A seventh distance d7 of the second parallel area 761 in the axial direction M may be less than about 1/15 of a sixth distance d6 of a roller portion of the second stretching roller 76 in the axial direction M (d6/15, i.e., 21 mm when d6=316 mm). Specifically; the seventh distance d7 of the second parallel area 761 in the axial direction M is 20 mm. An eighth distance d8 of the second inclined areas 762 in the axial direction M is 148 mm, a second diameter r2 of the second parallel area 761 is 12.67 mm, and an inclination angle θ2 of the second inclined areas 762 is 0.58 degrees.

Second Embodiment

The second embodiment is the same as the first embodiment except that the first stretching member 74 (74*a*) according to the first embodiment includes outer areas, and the description thereof is omitted.

Figure 8:
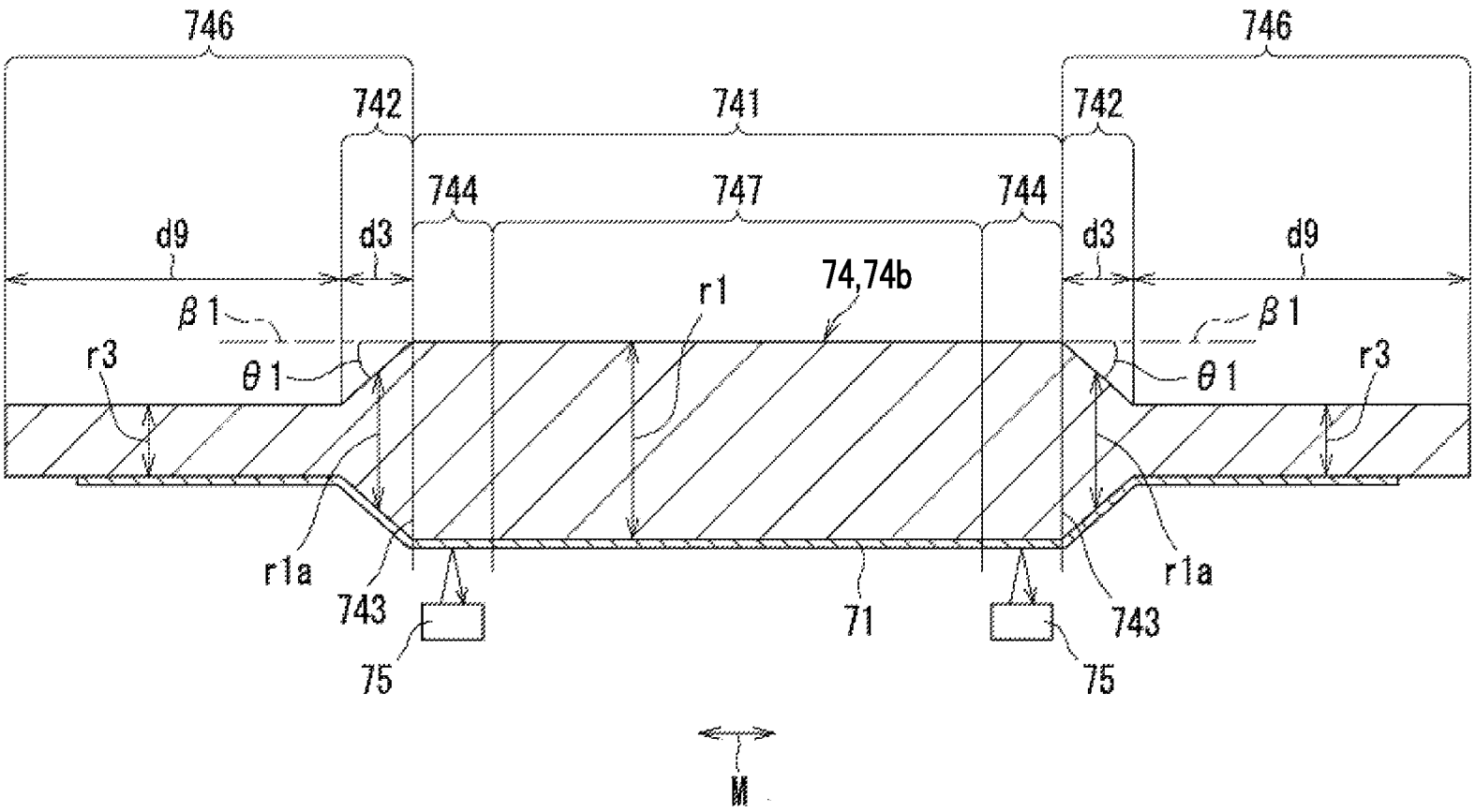
FIG. 8 is a cross-sectional view schematically illustrating an example in which the first stretching member according to the first embodiment includes outer areas according to a second embodiment.

FIG. 8 is a cross-sectional view schematically illustrating an example in which the first stretching member 74 (74*a*) according to the first embodiment includes outer areas 746 according to the second embodiment.

As illustrated in FIG. 8, the first stretching member 74 (74*b*) includes the outer areas 746. The outer areas 746 are connected to the outer sides of the first parallel area 741 with respect to the axial direction M and are retracted from the first parallel area 741 in a direction closer to the rotation axis α. Specifically, the outer areas 746 are areas that are connected to the outer sides of the first parallel area 741 with respect to the axial direction M and are retracted from the first virtual line β1 to a position away from the inner side of the transfer belt 71 with respect to the radial direction. Therefore, the inclination angle θ1 of the first inclined areas 742 may be increased, and thus the stretch of the belt from the first parallel area 741 to the first inclined areas 742 may be improved.

In the first stretching member 74 (74*b*), the outer areas 746 include outer parallel areas whose surface is parallel to the axial direction M. Thus, the workability of the first stretching member 74 (74*b*) may be improved, and the stretch of the belt from the first parallel area 741 to the first inclined areas 742 may be improved.

In the first stretching roller 74*b*, the outer parallel areas of the outer areas 746 are areas having a third diameter r3 that is smaller than the first diameter r1 of the first parallel area 741. The third distance d3 of the first inclined areas 742 in the axial direction M may be determined by the inclination angle θ1 of the first inclined areas 742. Specifically, the inclination angle θ1 of the first inclined areas 742 is 45 degrees, and the third distance d3 is 1.5 mm. Therefore, the third diameter r3 of the outer parallel areas of the outer areas 746 is 5 mm, and a ninth distance d9 of the outer parallel areas of the outer areas 746 in the axial direction M is 41.5 mm.

Third Embodiment

When the transfer belt 71 is in contact with the inner side of the first adjacent areas 744 of the first stretching member 74 (74*a*, 74*b*) with respect to the axial direction M, a crease due to the undulation of the transfer belt 71 is likely to occur on a contact area 747 (see FIGS. 6 and 8). Therefore, it is desirable to reduce or eliminate the contact area 747 of the transfer belt 71 on the inner side of the first adjacent areas 744 of the first stretching member 74 (74*a*, 74*b*) with respect to the axial direction M.

Figure 9A:
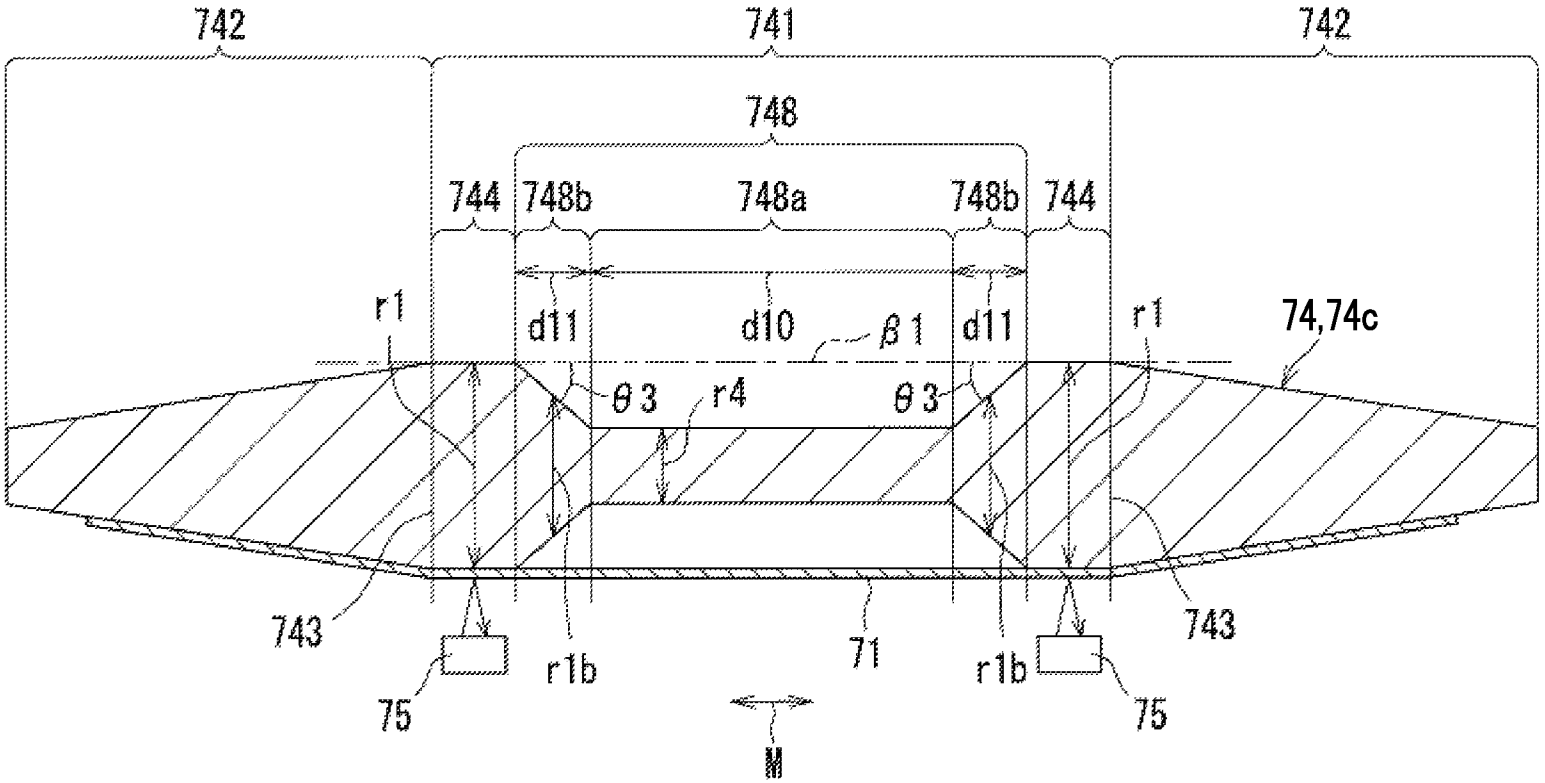
FIG. 9A is a cross-sectional view schematically illustrating an example where the first stretching member according to the first embodiment includes an inner displacement area according to a third embodiment.
Figure 9B:
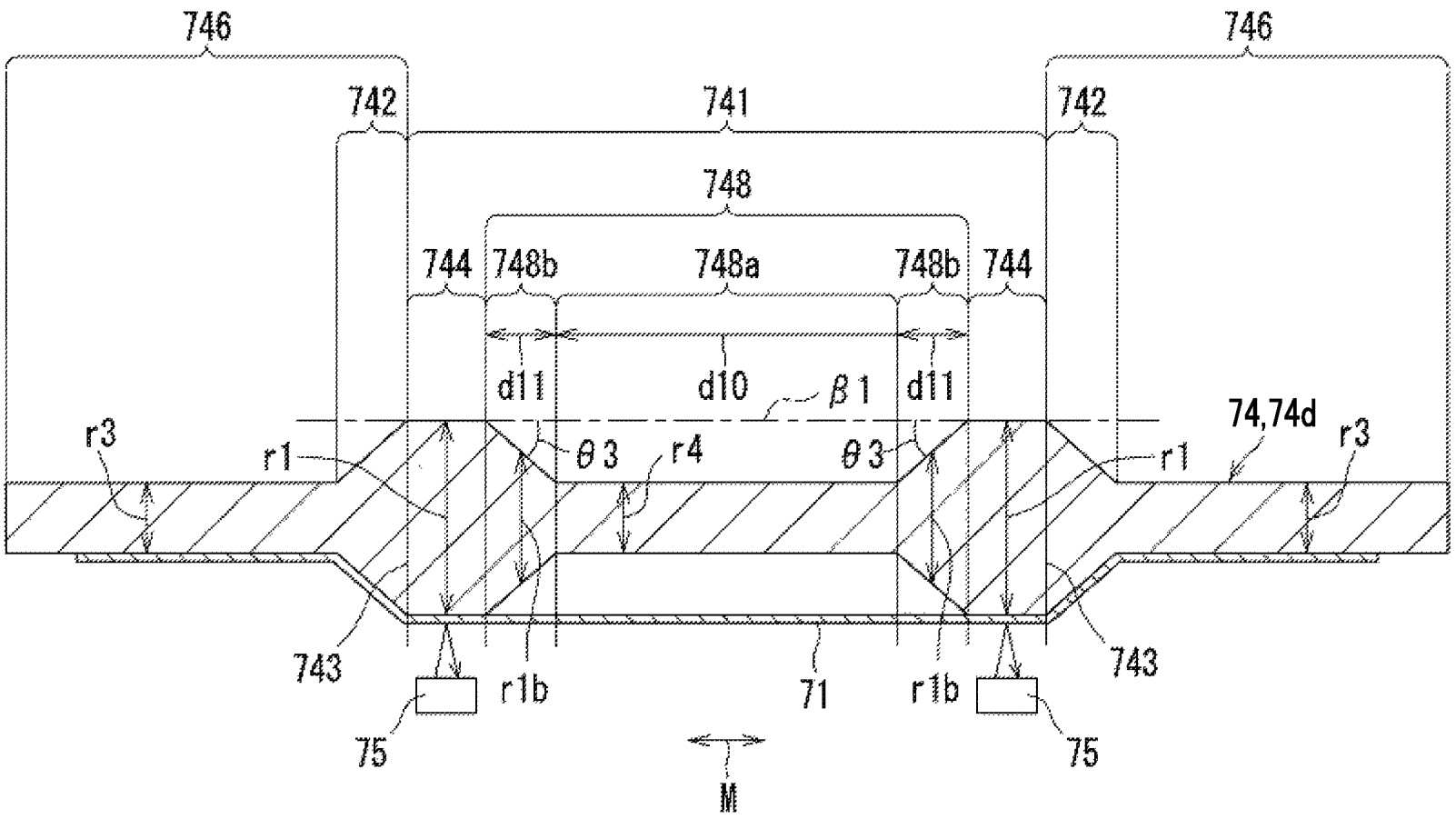
FIG. 9B is a cross-sectional view schematically illustrating an example where the first stretching member according to the second embodiment includes an inner displacement area according to the third embodiment.

FIGS. 9A and 9B are cross-sectional views schematically illustrating examples where the first stretching member 74 (74*a*) according to the first embodiment and the first stretching member 74 (74*b*) according to the second embodiment each include an inner displacement area 748 according to the third embodiment.

The third embodiment is the same as the first embodiment and the second embodiment except that the first stretching member 74 (74*a*) according to the first embodiment and the first stretching member 74 (74*b*) according to the second embodiment include the inner displacement area 748, and the description thereof is omitted.

As illustrated in FIGS. 9A and 9B, the first stretching member 74 (74*c*, 74*d*) includes the inner displacement area 748. The inner displacement area 748 is provided on the inner side of the first adjacent areas 744 with respect to the axial direction M and is displaced from the first parallel area 741 in a direction closer to the rotation axis α. Specifically, the inner displacement area 748 is an area that is provided on the inner side of the first adjacent areas 744 with respect to the axial direction M and is displaced to a position away from the first virtual line β1. Therefore, it is possible to reduce or eliminate (eliminate in this example) the contact area 747 of the transfer belt 71 on the inner side of the first adjacent areas 744 of the first stretching member 74 (74*a*, 74*b*) with respect to the axial direction M, and thus it is possible to effectively prevent the occurrence of a crease due to the undulation of the transfer belt 71 on the inner side of the first adjacent areas 744 with respect to the axial direction M.

According to the present embodiment, the inner displacement area 748 includes an inner parallel area 748*a* and inner inclined areas 748*b*. The inner parallel area 748*a* is an area whose surface is parallel to the axial direction M. The inner inclined areas 748*b* are connected to the outer sides of the inner parallel area 748*a* with respect to the axial direction M and are inclined in a direction away from the rotation axis α. Specifically, the inner inclined areas 748*b* are areas that are connected to the outer sides of the inner parallel area 748*a* with respect to the axial direction M and have a gradually decreasing distance from the first virtual line β1 touching the first parallel area 741 toward the outer sides in the axial direction M. Thus, the workability of the first stretching member 74 (74*c*, 74*d*) may be improved, and the occurrence of a crease due to the undulation of the belt on the inner side of the first adjacent area with respect to the axial direction M may be effectively prevented.

In the first stretching rollers 74*c* and 74*d*, the inner parallel area 748*a* is an area having a fourth diameter r4 smaller than the first diameter r1 of the first parallel area 741. The inner inclined areas 748*b* are areas that are connected to the outer sides of the inner parallel area 748*a* with respect to the axial direction M and have a gradually increasing diameter r1*b* of the first stretching rollers 74*c*, 74*d* toward the ends in the axial direction M. Specifically, an inclination angle θ3 of the inner inclined areas 748*b* with respect to the first virtual line β1 is 45 degrees, and an eleventh distance d11 of the inner inclined areas 748*b* in the axial direction M is 1.5 mm. Therefore, the fourth diameter r4 of the inner parallel area 748*a* is 5 mm, and a tenth distance d10 of the inner parallel area 748*a* in the axial direction M is 207 mm. In the first stretching roller 74*d*, the third diameter r3 and the fourth diameter r4 may be identical or different.

Fourth Embodiment

The fourth embodiment is the same as the first embodiment to the third embodiment except that a first stretching plate 74*e* is provided instead of the first stretching rollers 74*a* to 74*c* according to the first embodiment to the third embodiment, and the description thereof is omitted.

Figure 10:
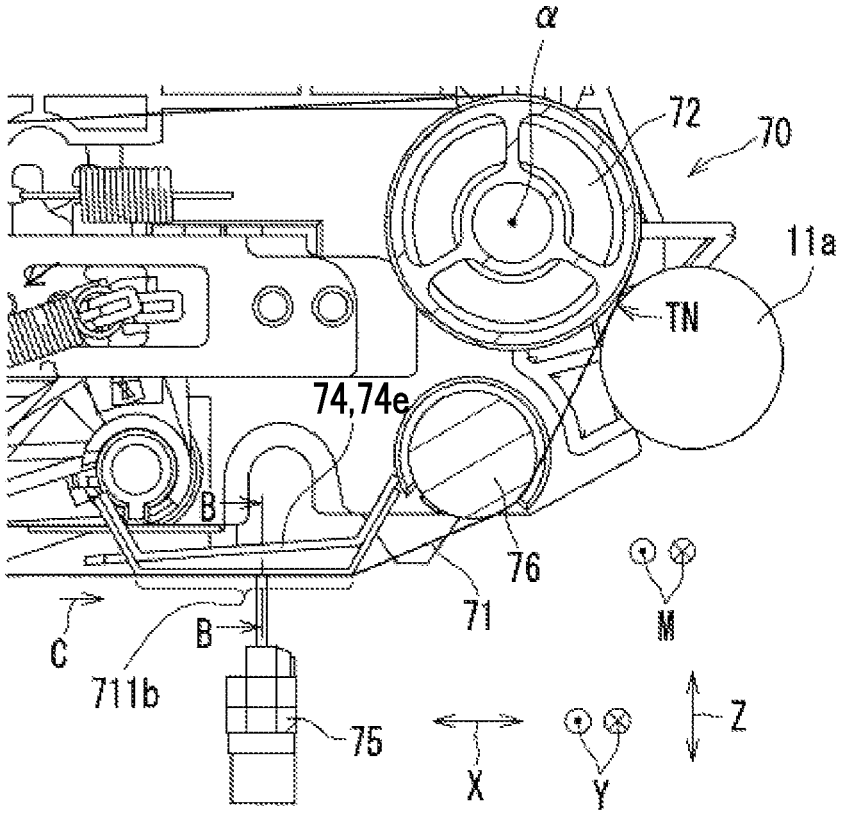
FIG. 10 is a cross-sectional view illustrating an example in which a first stretching plate is provided according to a fourth embodiment.
Figure 11A:
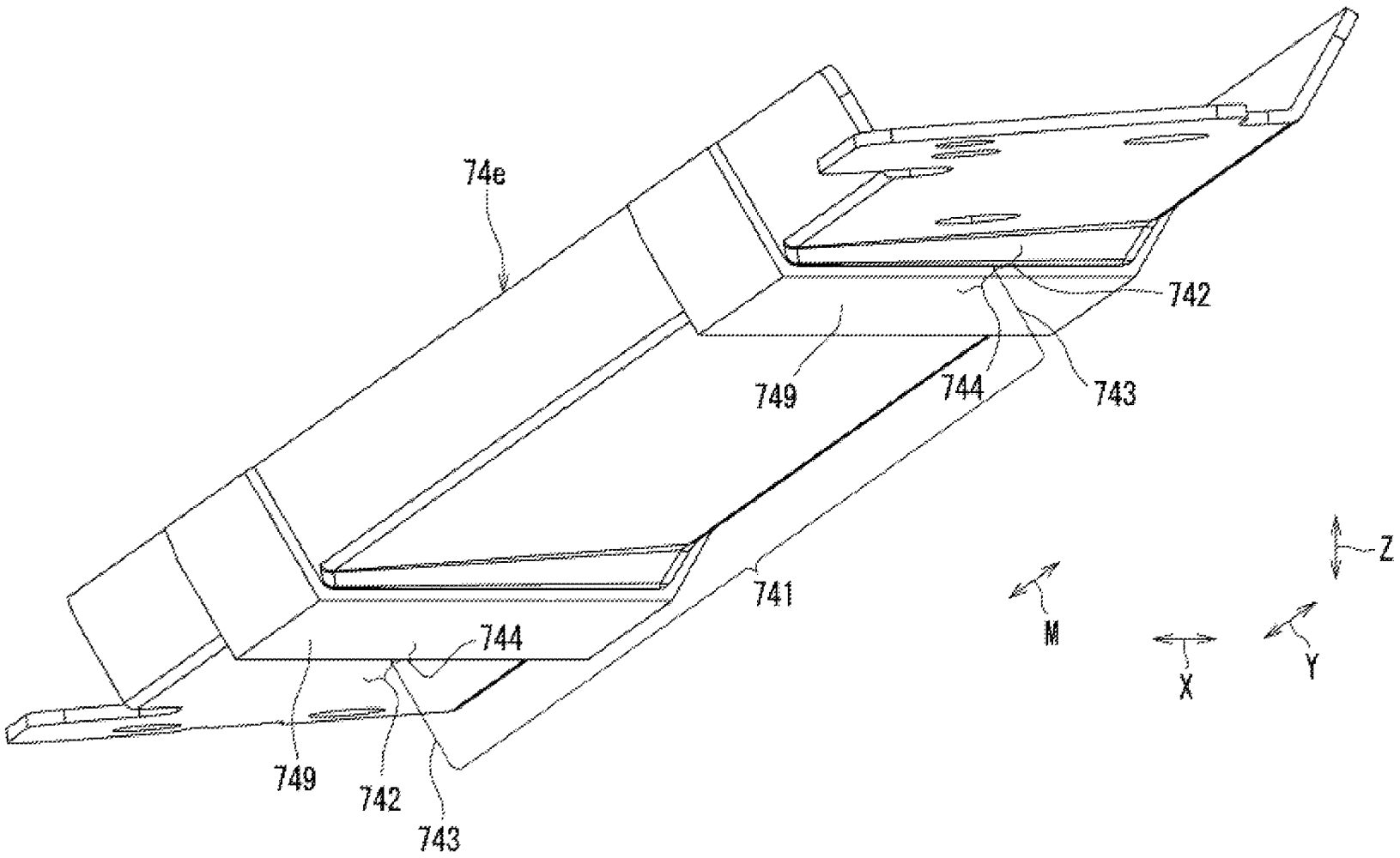
FIG. 11A is a perspective view of the first stretching plate according to the fourth embodiment as viewed from the lower left on the front side.
Figure 11B:
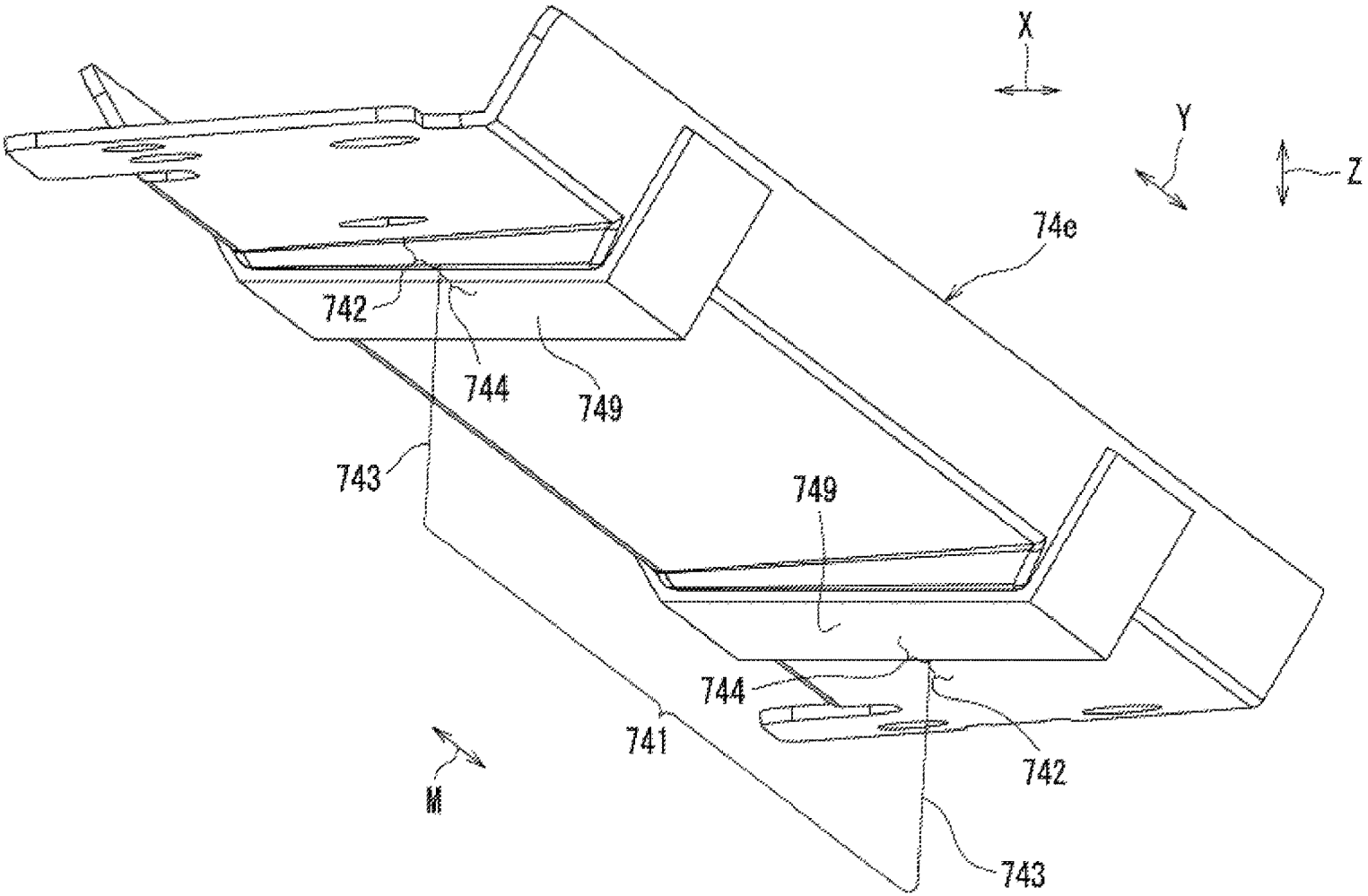
FIG. 11B is a perspective view of the first stretching plate according to the fourth embodiment as viewed from the lower right on the front side.
Figure 12A:
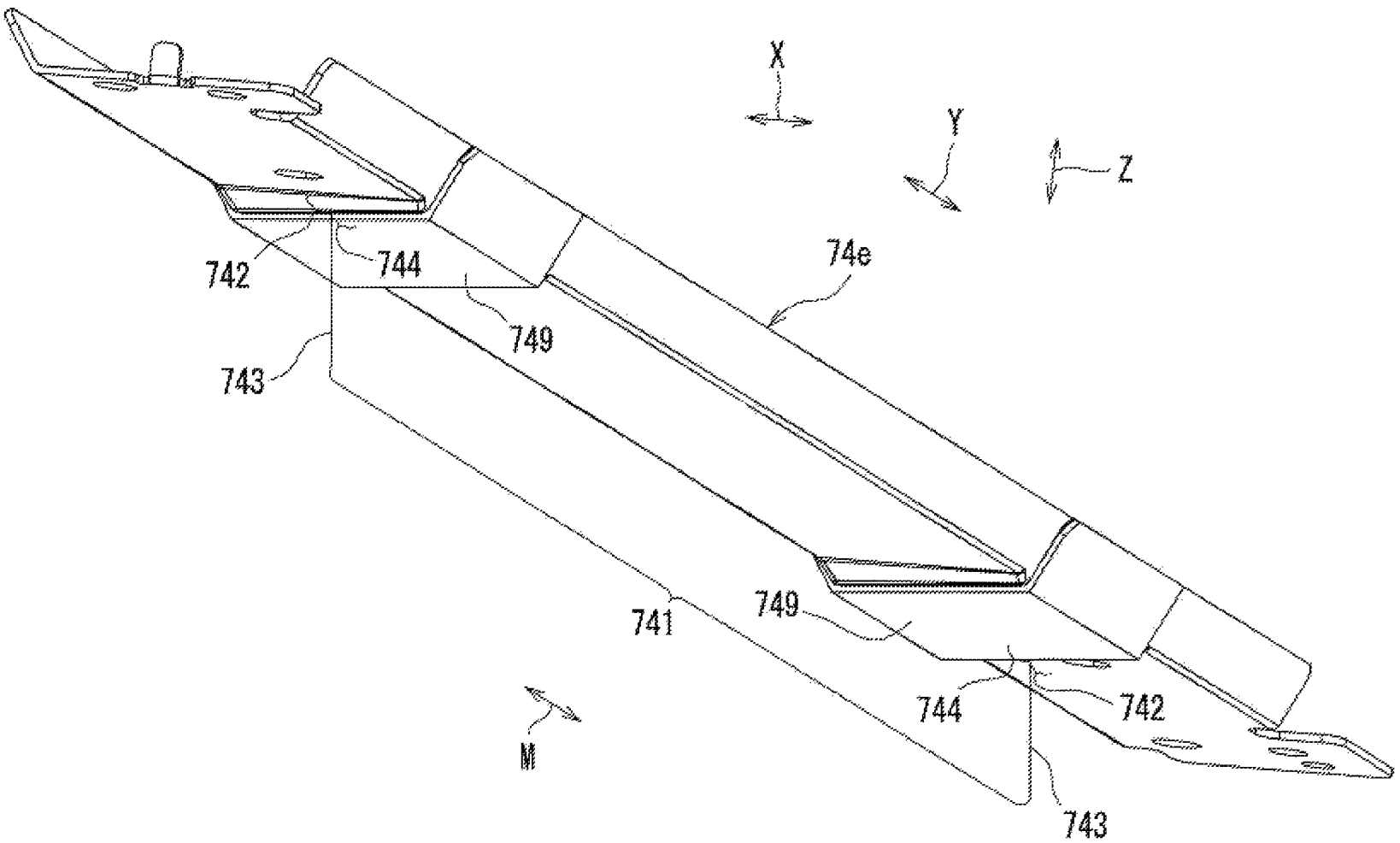
FIG. 12A is a perspective view of the first stretching plate according to the fourth embodiment as viewed from the lower right on the back side.
Figure 12B:
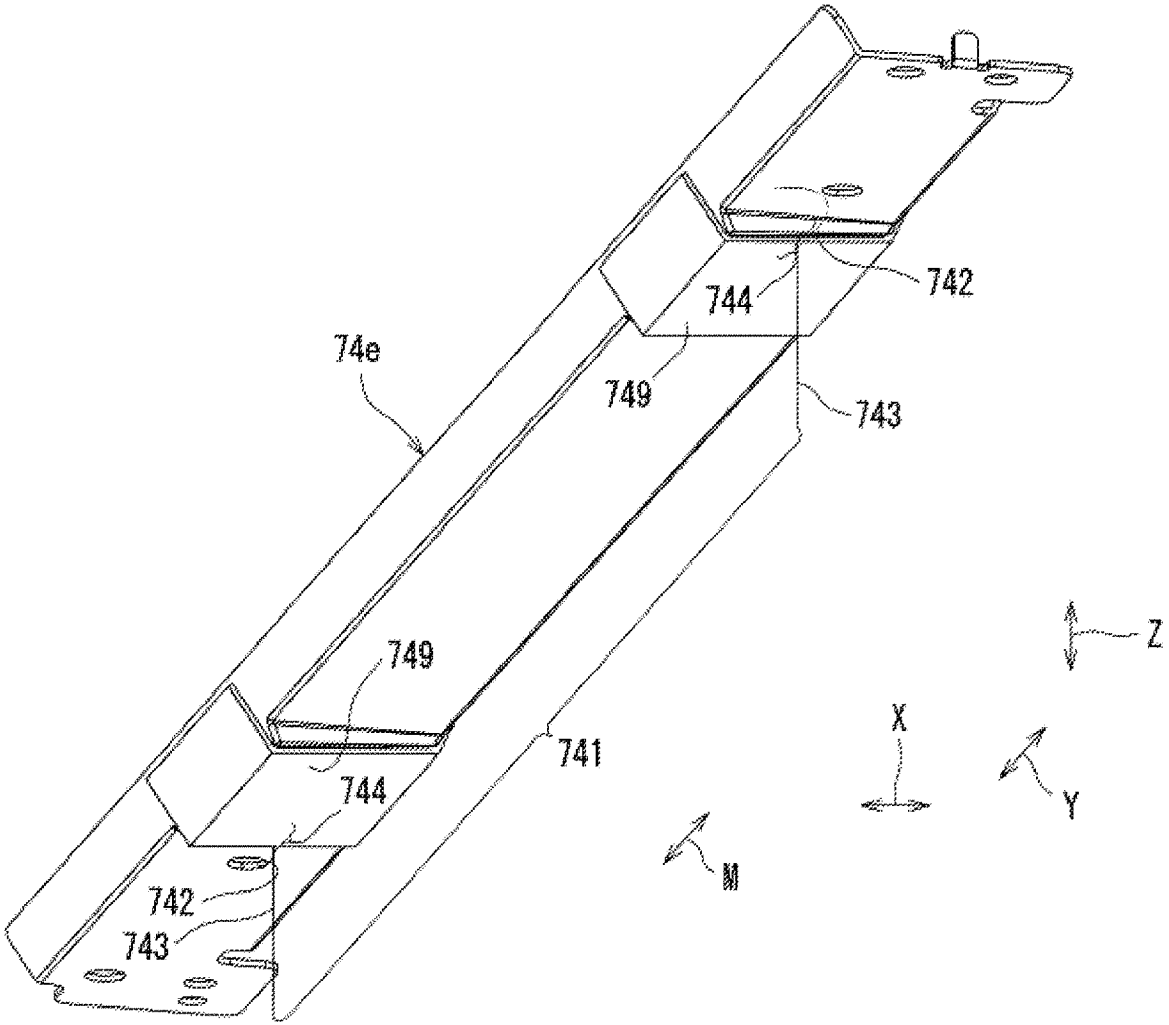
FIG. 12B is a perspective view of the first stretching plate according to the fourth embodiment as viewed from the lower left on the back side.
Figure 13:
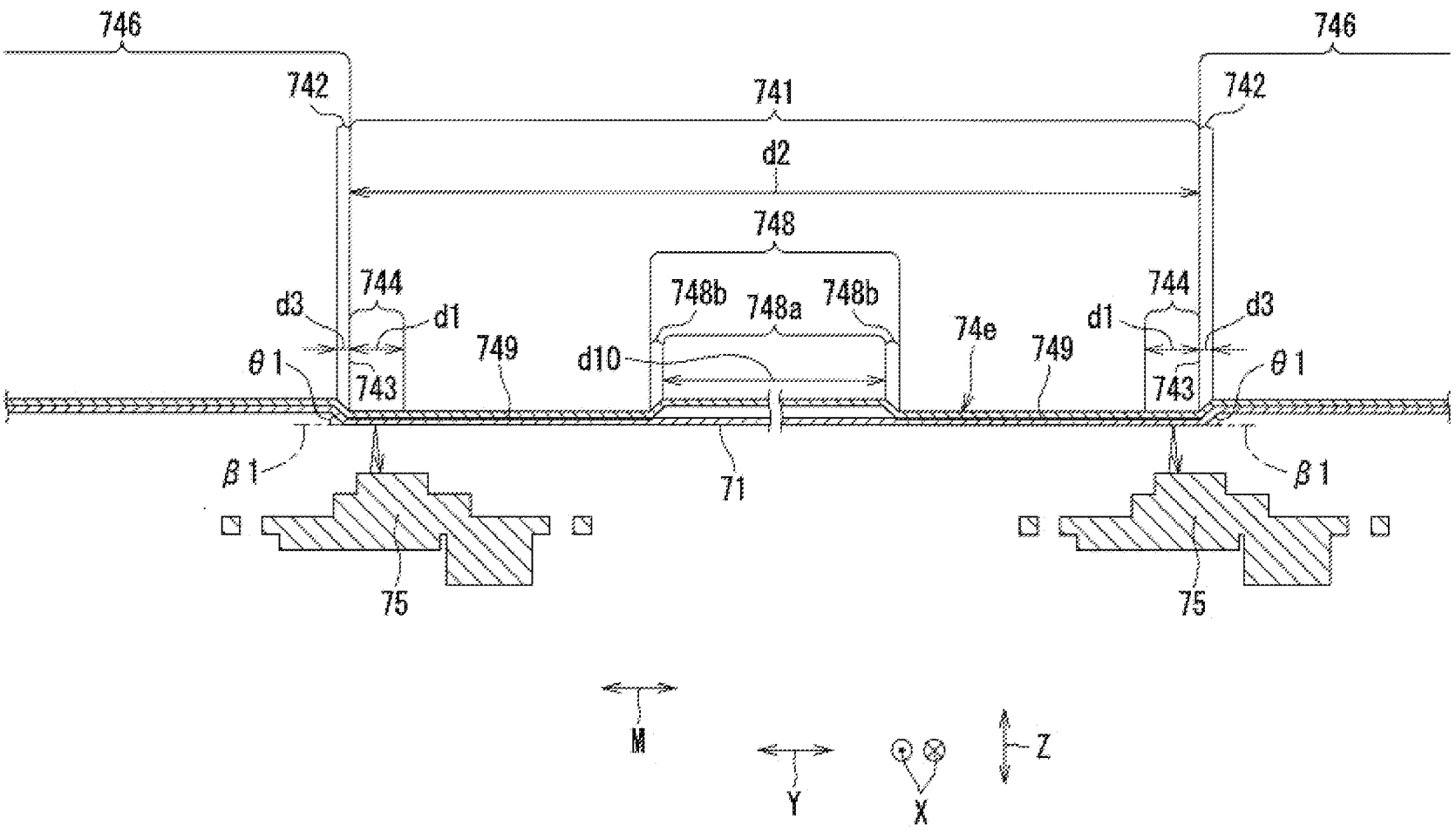
FIG. 13 is a cross-sectional view of the first stretching plate, a transfer belt, and the detectors in the transfer belt device according to the fourth embodiment along the line B-B illustrated in FIG. 10.

FIG. 10 is a cross-sectional view illustrating an example in which the first stretching plate 74*e* is provided according to the fourth embodiment. FIGS. 11A and 11B are perspective views of the first stretching plate 74*e* according to the fourth embodiment as viewed from the lower left and the lower right, respectively, on the front side. FIGS. 12A and 12B are perspective views of the first stretching plate 74*e* according to the fourth embodiment as viewed from the lower right and the lower left, respectively, on the back side. FIG. 13 is a cross-sectional view of the first stretching plate 74*e*, the transfer belt 71, and the detectors 75 in the transfer belt device 70 according to the fourth embodiment along the line B-B illustrated in FIG. 10.

According to the present embodiment, as the first stretching plate 74*e* is provided as the first stretching member 74, it is possible to ensure that the first stretching plate 74*e* stretches the transfer belt 71 from the first parallel area 741 toward the first inclined area 742, and accordingly a crease due to the undulation of the transfer belt 71 may be suppressed.

A crease due to the undulation of the transfer belt 71 is unlikely to occur on a contact area 711*b* (see FIG. 10) where the first stretching plate 74*e* is in contact with the transfer belt 71.

In this respect, according to the present embodiment, the detectors 75 detect the location corresponding to the contact area 711*b* where the first stretching plate 74*e* is in contact with the transfer belt 71. Therefore, a crease due to the undulation of the transfer belt 71 is unlikely to occur, and thus a reduction in the detection accuracy of the base of the transfer belt 71 and/or the toner image may be avoided.

The fourth embodiment may have the same configuration as those of the first embodiment to the third embodiment.

Specifically, according to the present embodiment, the inclination angle θ1 (see FIG. 13) of the first stretching plate 74*e* with respect to the first inclined areas 742 is 45 degrees or less.

As illustrated in FIG. 13, according to the present embodiment, the first stretching plate 74*e* includes outer areas 746. The outer areas 746 are areas that are connected to the outer sides of the first parallel area 741 with respect to the axial direction M and are retracted from the first parallel area 741 in a direction closer to the rotation axis α.

In this example, the first distance d1 of the first adjacent areas 744 is 10 mm. The third distance d3 of the first inclined areas 742 in the axial direction M is 1.5 mm, and the inclination angle θ1 of the first inclined areas 742 is 45 degrees.

According to the present embodiment, the outer areas 746 include an outer parallel area whose surface is parallel to the axial direction M.

The first stretching plate 74*e* includes the inner displacement area 748. The inner displacement area 748 is an area that is provided on the inner side of the first adjacent areas 744 with respect to the axial direction M and is displaced from the first parallel area 741 in a direction closer to the rotation axis α.

According to the present embodiment, the inner displacement area 748 includes the inner parallel area 748*a* and the inner inclined areas 748*b*. The inner parallel area 748*a* is an area whose surface is parallel to the axial direction M. The inner inclined areas 748*b* are connected to the outer sides of the inner parallel area 748*a* with respect to the axial direction M and are inclined in a direction away from the rotation axis α. Specifically, the inner inclined areas 748*b* are areas that are connected to the outer sides of the inner parallel area 748*a* with respect to the axial direction M and have a gradually decreasing distance from the first virtual line β1 touching the first parallel area 741 toward the outer sides in the axial direction M. Specifically, the inclination angle θ3 of the inner inclined areas 748*b* with respect to the first virtual line β1 is 45 degrees, and the eleventh distance d11 of the inner inclined areas 748*b* in the axial direction M is 1.5 mm. The tenth distance d10 of the inner parallel area 748*a* in the axial direction M is 174 mm.

Protective members 749 (see FIGS. 11A to 12B) are provided on an area of the first parallel area 741 except for the inner displacement area 748.

Other Embodiments

According to the first embodiment to the fourth embodiment, the first stretching member 74 (74*a* to 74*e*) is provided under the transfer belt 71; however, the first stretching member 74 (74*a* to 74*e*) may be provided above the transfer belt 71.

The present invention is not limited to the embodiments described above and may be implemented in other various forms. Therefore, the embodiments are merely examples in all respects and should not be interpreted in a limited way. The range of the present invention is indicated by the scope of claims and is not limited by the main body of the description. All modifications and changes belonging to the range equivalent to the scope of claims are included within the range of the present invention.

What is claimed is:

1. A belt device comprising:

a first stretching member that stretches an endless belt capable of rotational movement; and a detector that detects a base of the belt and/or a density of a toner image on the belt, wherein the first stretching member includes a first parallel area that is parallel to an axial direction, which is a direction of a rotation axis of the belt, and a first inclined area that is connected to an outer side of the first parallel area with respect to the axial direction and is inclined in a direction closer to the rotation axis, wherein the detector detects a location corresponding to a first boundary between the first parallel area and the first inclined area or a location corresponding to a predetermined first adjacent area that is adjacent to and on an inner side of the first boundary.

2. The belt device according to claim 1, wherein an inclination angle of the first stretching member with respect to the first inclined area is 45 degrees or less.

3. The belt device according to claim 1, wherein the first stretching member is a first stretching roller.

4. The belt device according to claim 3, wherein the detector detects a location corresponding to a predetermined second adjacent area that is located on an upstream side of and adjacent to a second boundary between a contact area where the first stretching roller is in contact with the belt and a non-contact area on the upstream side of the contact area, in a circumferential direction around the rotation axis.

5. The belt device according to claim 1, wherein the first stretching member is a first stretching plate.

6. The belt device according to claim 5, wherein the detector detects a location corresponding to a contact area where the first stretching plate is in contact with the belt.

7. The belt device according to claim 1, further comprising a second stretching roller that is located downstream of the first stretching member in a circumferential direction around the rotation axis, wherein the second stretching roller includes a second parallel area that is parallel to the axial direction, and a second inclined area that is connected to an outer side of the second parallel area with respect to the axial direction and is inclined in a direction closer to the rotation axis.

8. The belt device according to claim 1, wherein the first stretching member includes an outer area that is connected to an outer side of the first parallel area with respect to the axial direction and is retracted from the first parallel area in a direction closer to the rotation axis.

9. The belt device according to claim 1, wherein the first stretching member includes an inner displacement area that is provided on an inner side of the first adjacent area with respect to the axial direction and is displaced from the first parallel area in a direction closer to the rotation axis.

10. The belt device according to claim 9, wherein the inner displacement area includes an inner parallel area that is parallel to the axial direction.

11. An image forming apparatus comprising the belt device according to claim 1.

* * * * *